United States Patent [19]

Kourimsky

[11] Patent Number: 4,555,156

[45] Date of Patent: Nov. 26, 1985

[54] ELECTRICAL CONNECTOR ASSEMBLY HAVING MATING AND UNMATING REMOVABLE KEYS

[75] Inventor: Friedrich J. A. Kourimsky, Bensheim, Fed. Rep. of Germany

[73] Assignee: AMP Incorporated, Harrisburg, Pa.

[21] Appl. No.: 672,051

[22] Filed: Nov. 16, 1984

[51] Int. Cl.[4] ..... H01R 13/629

[52] U.S. Cl. ..... 339/75 M; 339/82

[58] Field of Search ..... 339/75 R, 75 M, 82

[56] References Cited

U.S. PATENT DOCUMENTS

| | | | |
|---|---|---|---|
| Re. 28,171 | 9/1974 | Anhalt | 339/75 M |
| 3,676,832 | 7/1972 | Judge et al. | 339/75 M |
| 3,848,222 | 11/1974 | Lightner | 339/75 M |
| 4,498,725 | 2/1985 | Bright et al. | 339/75 M |

*Primary Examiner*—John McQuade
*Attorney, Agent, or Firm*—Frederick W. Raring

[57] ABSTRACT

Electrical connector assembly comprises first and second housing assemblies containing first and second terminals. The terminals are of the type which are mated by locating a plug terminal in offset parallel relationship to a socket and then moving the terminals laterally towards each other. The two connector parts are mated and unmated by means of separate keys which have eccentrics on their ends that cooperate with camming surfaces on one of the connector assemblies. The key which is used for mating the connector assemblies is incapable of disengaging them and the disengaging key is incapable of engaging the connectors with each other. Rigid control of the mating and unmating of the connector assemblies is thereby achieved.

10 Claims, 14 Drawing Figures

ELECTRICAL CONNECTOR ASSEMBLY HAVING MATING AND UNMATING REMOVABLE KEYS

FIELD OF THE INVENTION

This invention relates to multi-contact electrical connector assemblies of the type having force multiplying means to assist the operator in mating and unmating the connectors.

BACKGROUND OF THE INVENTION

It is common practice to design multi-contact electrical connector assemblies with a force multiplying means to assist the technician in mating and unmating the connector parts. Where the individual connector parts have a large number of terminals therein, the force required to mate the two connector parts with each other and to unmate the connector parts can become quite high and it is therefore common to provide a camming means or the like to assist the operator in carrying out this operation. In accordance with one aspect thereof, the present invention is directed to the achievement of a connector assembly having an improved force multiplying device for mating and unmating the connector parts with each other. The invention is particularly directed to connectors having terminals of the type which are coupled to each other by placing the terminals in aligned overlapping offset relationship and moving the terminals laterally towards each other. The force multiplying means is thus of the type which moves the connector parts laterally with respect to each other after they have been placed in closed proximity.

In accordance with another aspect thereof, the invention is directed to improved security or control over the mating and unmating of the two connector parts of a connector assembly. Multi-contact electrical connectors are used in very large numbers under many circumstances where the mating and unmating is extremely critical and must not be carried out excepting by authorized persons under carefully controlled conditions. For example, electrical generating stations have relatively complex control systems which involve perhaps many hundreds of multi-contact electrical connector assemblies and it is extremely important that the connector assemblies be mated and unmated only with the approval of the authority which is in charge of the power generating station. The two connector parts of the connector assembly in accordance with the present invention can be mated with each other or unmated only by persons having removable parts of the connector assembly thereby to insure that mating and nonmating will not be carried out by mistake or by unauthorized persons.

THE INVENTION

A multi-contact electrical connector assembly in accordance with the invention is of the type comprising two connector parts, each of the parts comprising a housing assembly having contact terminals therein. Each housing assembly has a mating face, oppositely facing endwalls, and oppositely facing sidewalls, the endwalls and the sidewalls extending substantially perpendicularly of the mating face. The contact terminals in the housing assemblies are of the type having a contact portion which is adjacent to the mating face. The terminals are further of the type which are mated with each other by moving the terminals axially towards each other until the contact portions of the terminals are in aligned overlapping and axially offset relationship. The terminals are thereafter moved laterally of their axes in a first lateral direction towards each other to engage the terminals with each other and the terminals are disengageable by moving them laterally of their axes in a second lateral direction which is the opposite direction from the first lateral direction. A connector assembly in accordance with the invention is characterized in that a guide means is provided on the housing assemblies for guiding the assemblies towards each other from a spaced-apart position to a closed position in which the mating faces are substantially against each other and the contact portions of the terminals are in overlapping offset and aligned relationship. First and second camming systems are provided for moving the housing assemblies in the first and second lateral directions respectively. The first camming system is incapable of moving the housing assemblies in the second lateral direction and the second camming system is incapable of moving the housing assemblies in the first lateral direction. The first and second camming systems are independent of each other and at least one of the camming systems has a readily removable camming part which, upon removal, immobilizes the camming system whereby the housing assemblies cannot be moved in one of the lateral directions.

In accordance with further embodiments, each of the first and second camming systems has a readily removable camming part. The readily removable camming part comprises in one embodiment a key which has a cylindrical shank portion having a free end. An eccentric projection is provided on the free end and one of the housing parts has a cylindrical supporting bearing through which the free end of the key is insertable. The bearing is dimensioned to support the shank portion for rotation. The other connector assembly has a camming surface which is engageable by the eccentric projection upon rotation of the key thereby to move the housing assemblies in the lateral direction.

In accordance with a preferred embodiment, the first and second camming systems are provided each of which requires a key. The keys are similar but are not alike so that neither of the keys can be used with the camming system for which it is not intended.

THE DRAWING FIGURES

THE DISCLOSED EMBODIMENT

Figure 1:
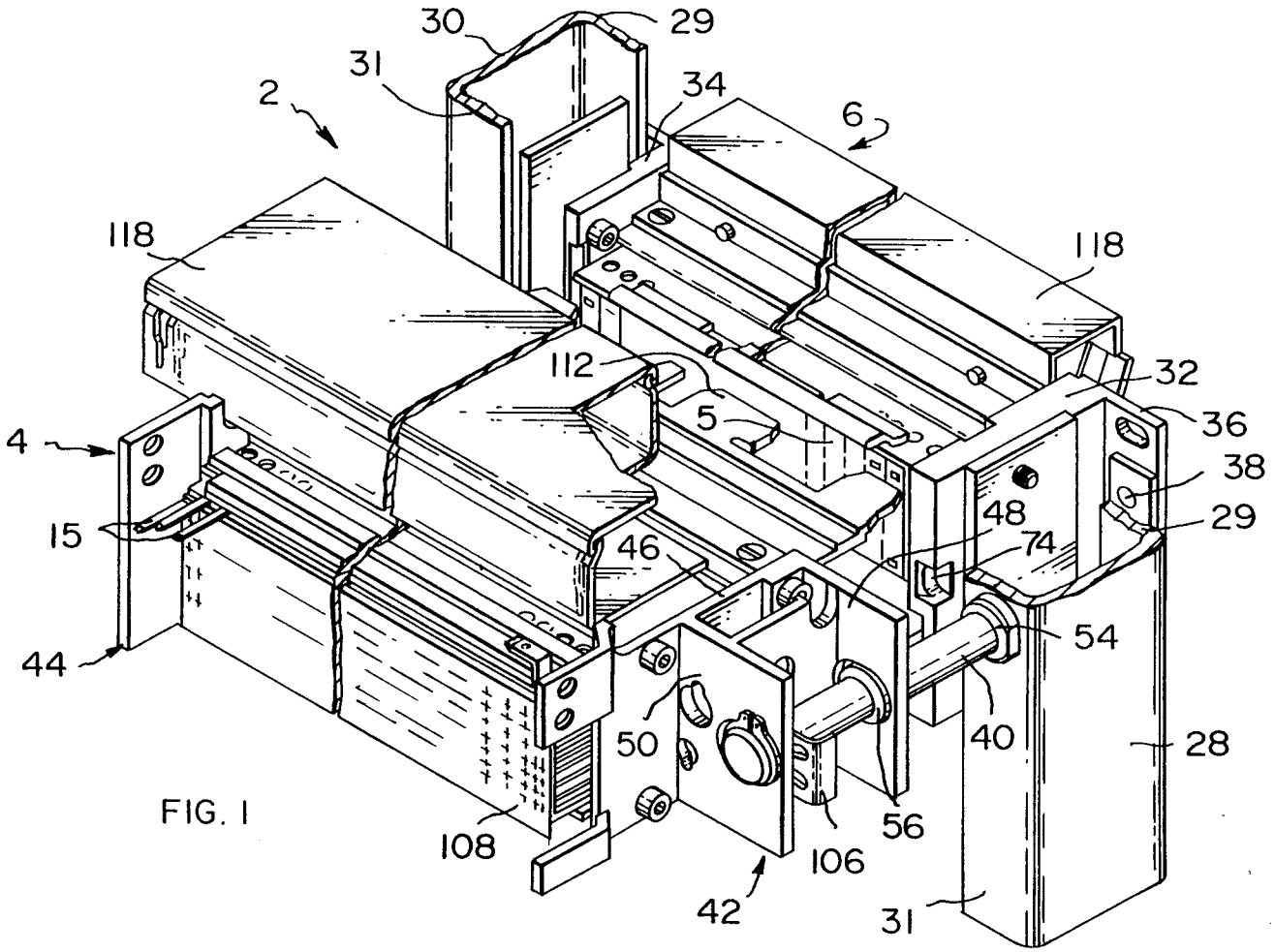
FIG. 1 is a perspective view showing a connector assembly in accordance with the invention, this view showing the condition of the parts when the housing assemblies of the connector assembly are spaced from each other.

Referring first to FIGS. 1–3, 7 and 8, a connector assembly 2 in accordance with the invention comprises first and second housing assemblies 4, 6 having first and second terminals 8, 10 therein. The terminals 8 in the first housing assembly 4 (FIGS. 4–6) are in the form of elongated posts members having a rectangular cross section. The right-hand end 12 serves as a contact plug and has a free end 14 and one side edge 16 which enters the receptacle terminal as will be described below. The individual elongated terminals 8 extend entirely through modules in the housing assembly 4 and have left-hand ends 15 as viewed in FIG. 4 which are connected to discrete wires by clip type connections as required.

Each of the terminals 10 contained in the second housing assembly 6 comprises a receptacle portion 18, an intermediate transition section 20 and a post portion 22. The transition section 20 is generally u-shaped having a web 24 and the sidewalls of this transition section extend leftwardly in FIG. 4 to provide two spaced-apart spring arms 26. The free ends of the spring arms have divergently extending ears which guide the side edge of the corresponding terminal 8 into mated relationship with the spring arms 26 as illustrated in FIGS. 5 and 6.

Figure 5:
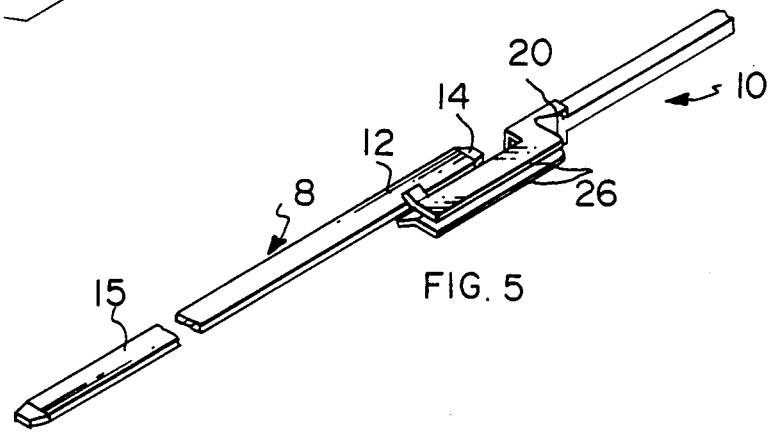
FIGS. 5 and 6 are views similar to FIG. 4 but illustrating the movement of the terminals when they are mated with each other.
Figure 6:
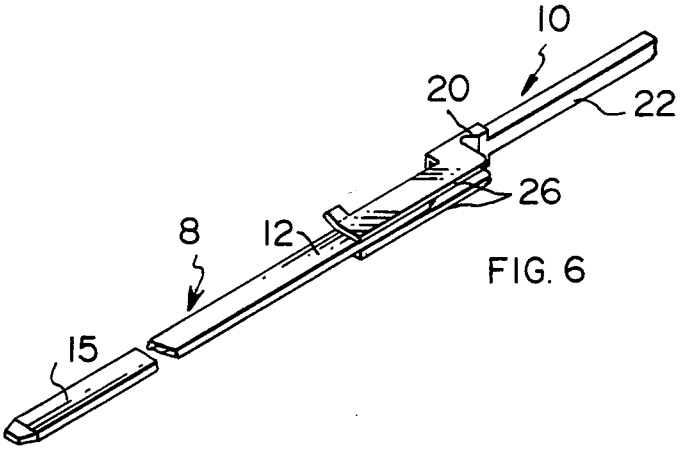

An individual terminal 8 is mated with an individual terminal 10 by locating the end portion 12 of the terminal 8 as shown in FIG. 5 in overlapping offset relationship with respect to the spring arm 6 and then moving the two terminals laterally of their axes relatively towards each other until they are fully mated as shown in FIG. 6. The lateral movement is relatively slight, and depending upon the contact force required, the force required for mating a multi-contact electrical connector assembly which may contain several hundred individual terminals can be quite high.

In the description which follows, only the essential parts of the housing assemblies 4, 6 which are relevant to the invention will be described in detail and other features will then be briefly described.

Each of the housing assemblies 4, 6 is composed of a plurality of individual modules which are contained between, and maintained and assembled relationship by, end plates and side plates. Each housing assembly has a mating face 3, 5 oppositely facing end walls, and oppositely facing sidewalls. The post portions of the terminals extend from the rearward faces of the housing assemblies so that wires can be connected to these posts which will extend to other connectors and to the control units in the system in which the connectors are used.

The housing assembly 6 is mounted between vertically extending channel members 28, 30 each of which has side flanges as shown at 29, 31. It is contemplated with the disclosed embodiment that a large number of similar connector assemblies will be used in close proximity to each other and the assembly 6 of each connector assembly will be mounted on the vertical members 28, 30.

The housing assembly 6 has right-hand and left-hand end plates as shown at 32, 34. These end plates have laterally extending flanges 36 which project outwardly from the endwalls of the housing assembly and which are secured by fasteners 38 to the flanges 29 of the vertical supports 28, 30. Guide rods 40 are secured by fasteners to the flanges 31 of the supports 28, 30 and project outwardly beyond the endwalls of the housing assembly 4.

The housing assembly 4 has end plates 42, 44 which are similar but not identical to each other. Both of these end plates receive a guide rod 40 and both cooperate in guiding the housing assembly 4 towards the housing assembly 6. However, the keys for mating and unmating the connector parts cooperate only with the end plate 42 which will now be described in detail.

Figure 7:
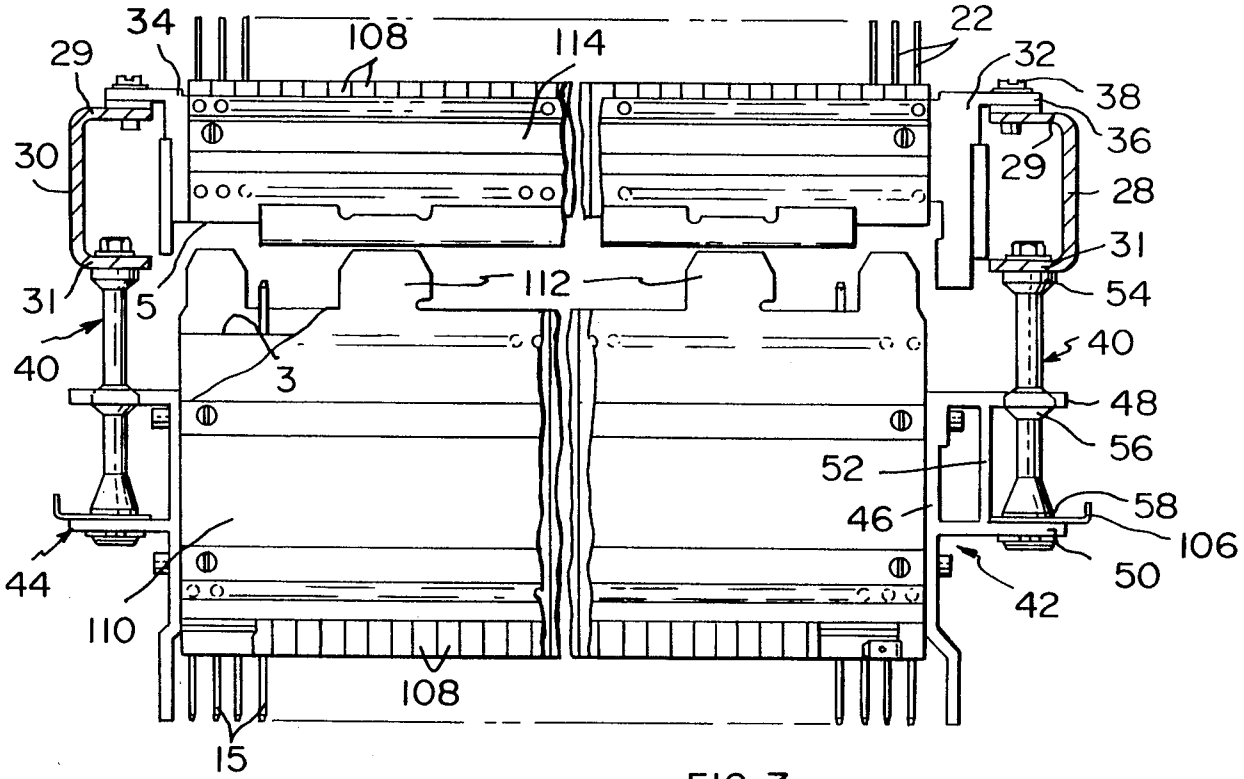
FIG. 7 is a top plan view of the connector assembly of FIG. 1 showing the positions of the parts in their unmated and spaced apart condition.
Figure 8:
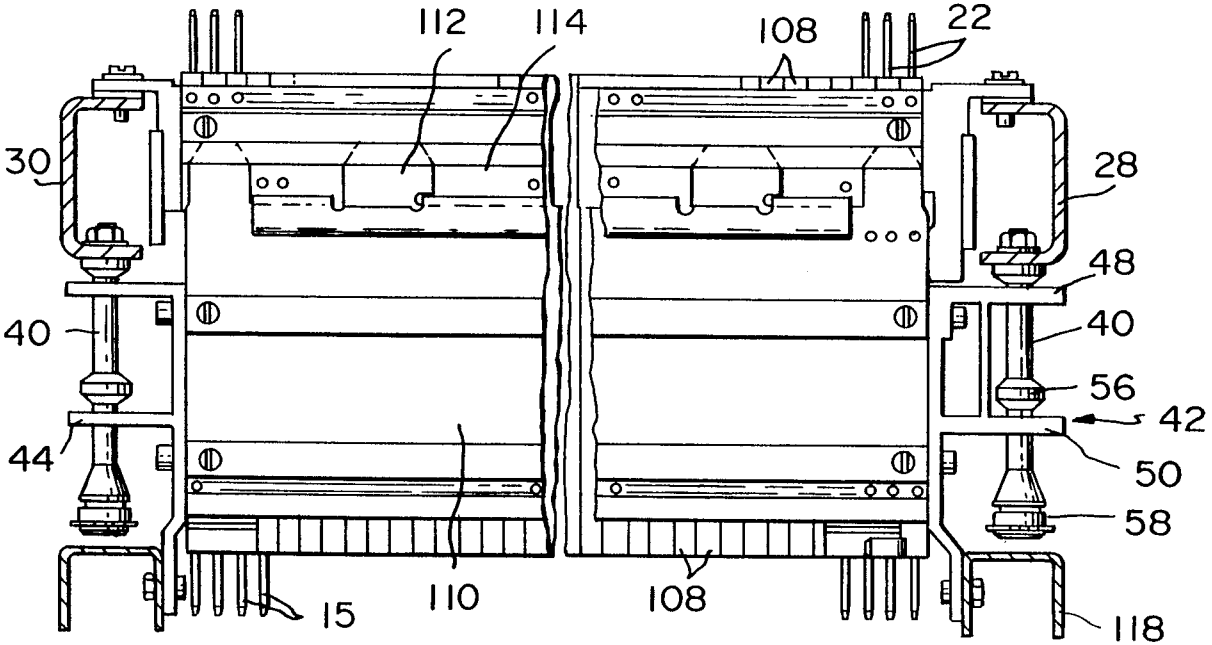
FIG. 8 is a view similar to FIG. 7 showing the positions of the parts when they are mated with each other.
Figure 9:
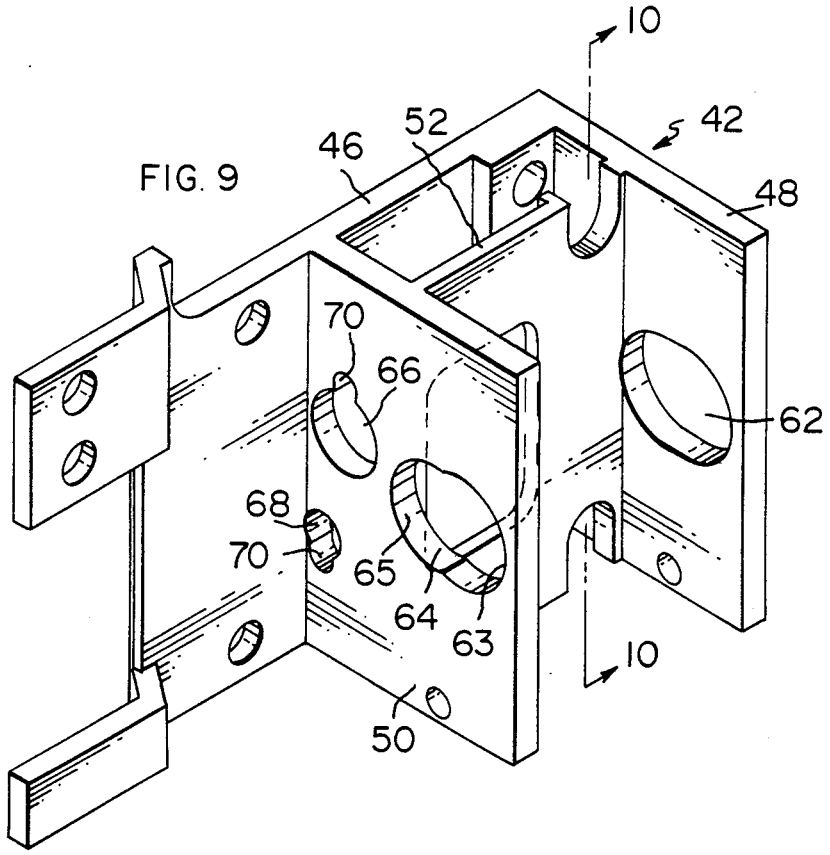
FIG. 9 is a perspective view showing one of the end plates of one of the parts of the housing assemblies.
Figure 10:
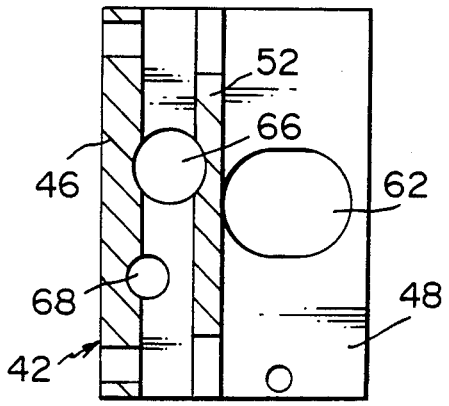
FIG. 10 is a view looking in the direction of the arrows 10—10 of FIG. 9.

End plate 42 has a base or web 46 which is secured against the right-hand endwall of the housing assembly 4 and which has laterally extending spaced-apart parallel ears 48, 50 with a strengthening rib 52 extending between these ears as shown in FIG. 7. The guide rod 40 has an enlarged diameter portion 56 intermediate its ends and another enlarged diameter portion 58 at its free end. The ears 48, 50 are provided with aligned openings 62, 64 as shown in FIGS. 3, 9 and 10 which receive the guide rod. The opening 62 in ear 48 is generally oval shaped and is dimensioned to receive the enlarged diameter portion 56 of the guide rod as shown in FIGS. 7 and 8 while permitting lateral movement of the housing assembly 4 with respect to the guide rod. The opening 64 in the ear 50 is also generally oval shaped. This opening is on its right-hand side as viewed in FIG. 9 of a slightly greater radius than it is on its left-hand side as viewed in the drawing. The slightly enlarged radius shown at 63 is provided in order to permit the enlarged diameter end portion 58 of the guide rod to be received therein as shown in FIGS. 1 and 7. This enlarged diameter end portion 58 cannot move relatively into the reduced radius portion 65 of opening 64. It will be apparent from FIG. 7 that the intermediate enlarged diameter portion of the guide rod is received in the opening 62 when the parts are spaced-apart as shown in FIG. 7. It is desirable to provide a retainer as shown at 106 in FIG. 1 to hold the parts in their unmated and spaced-apart position. This retainer is removed when the housing assembly 4 is moved towards the housing assembly 6 as shown in FIG. 2.

Figure 12:
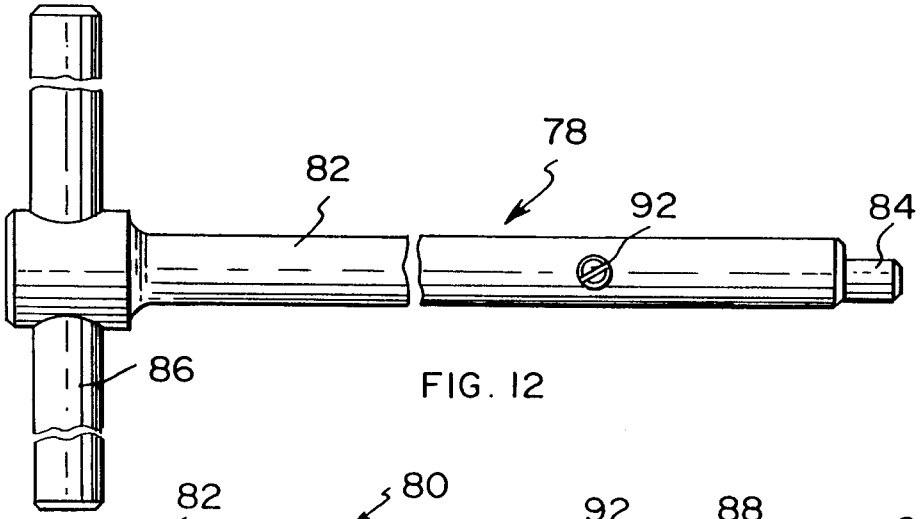
FIG. 12 is a view showing the key having an eccentric on its end for mating the connector housing parts with each other.
Figure 13:
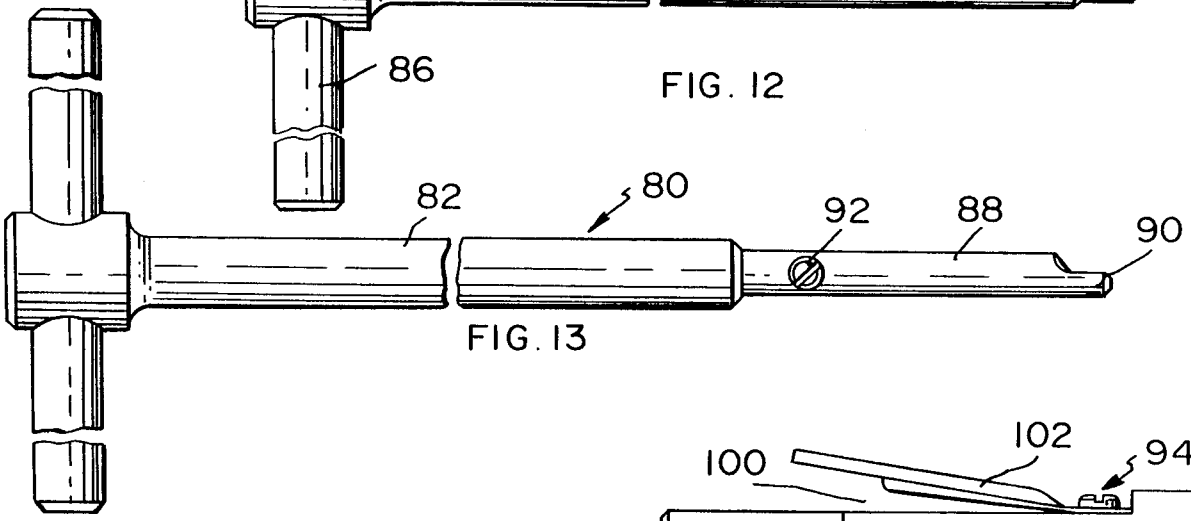
FIG. 13 is a view showing the key which is used to unmate the housing assemblies.

Aligned key openings 66 are provided in the ears 48, 50 for a key 78 and a second pair of aligned key receiving openings 68 are provided for a key 80, these keys being shown in FIGS. 12 and 13. The openings 66 are of a diameter which is substantially greater than the diameter of the openings 68 so that the larger diameter key can be inserted through the openings 68 in the ears 48, 50 only. Radially extending recesses as shown at 70 are provided in both of the openings in the ear 50 only to insure correct orientation in a rotational sense when the keys are inserted into the openings.

Figure 11:
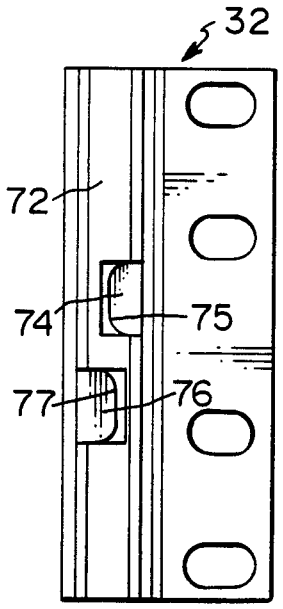
FIG. 11 is a fragmentary view showing the camming surfaces which are cooperable with the eccentric camming keys to mate and unmate the connector assembly.

The end plate 32 on the housing assembly 6 has an edge 72 which faces towards the housing assembly 4 and camming recesses 74, 76 are provided in this edge which are in alignment with the opening 66, 68. The camming recess 74 is open on its right-hand side as viewed in FIG. 11 and is used only for moving the housing assembly 4 relatively rightwardly as viewed in FIG. 1 to the position of FIG. 3. The camming recess 76 is open on its left-hand side as viewed in FIG. 11 and is employed only to move the housing assembly 4 leftwardly from the position of FIG. 3 to the position of FIG. 2.

Figure 2:
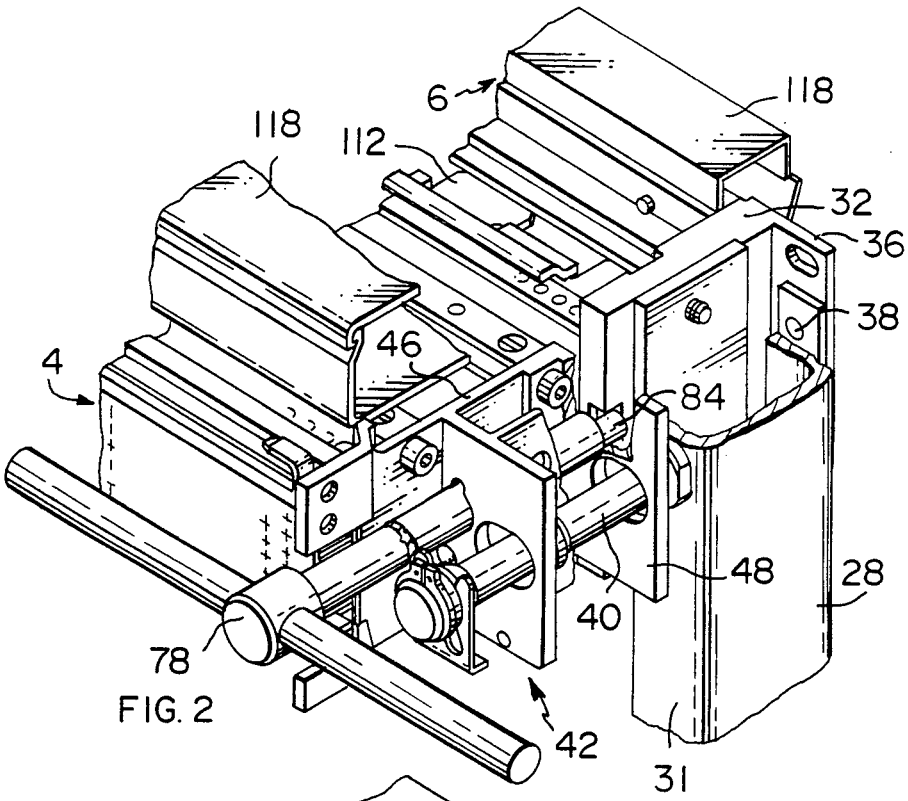
FIGS. 2 and 3 are fragmentary views illustrating the manner in which the housing assemblies are moved towards each other and then laterally to engage the terminals in the housing assemblies with each other.
Figure 3:
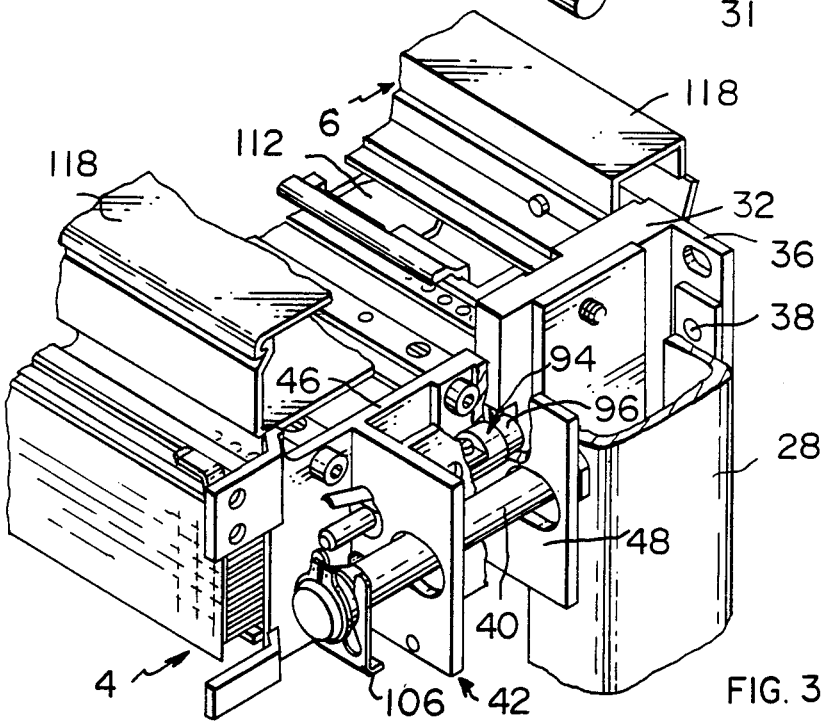
Figure 4:
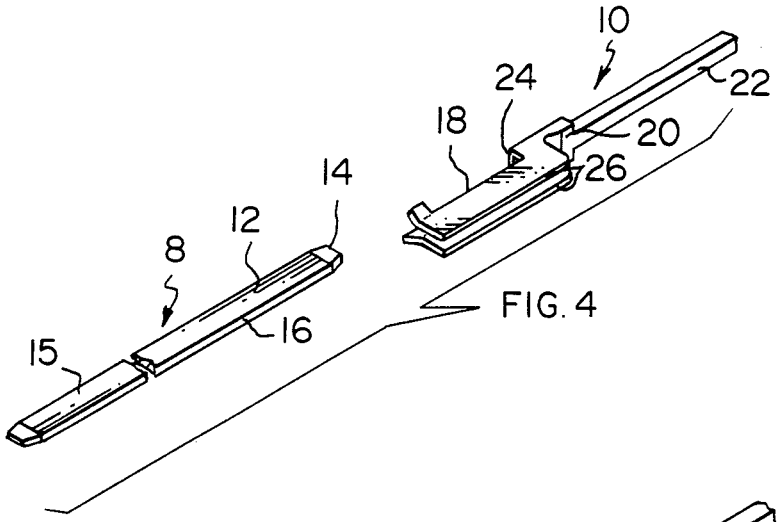
FIG. 4 is a perspective view showing the types of terminals used in the housing assemblies, this view showing the two terminals in spaced aligned relationship.

The key 78 which is used to move the housing assembly 4 rightwardly as viewed in FIGS. 1–3 has an elongated shank portion 82 of uniform diameter and has an eccentric projection 84 on its end. A handle 86 is provided for rotating the key after it has been inserted through the opening. An aligning screw 92 is provided to insure that the key will be in the proper orientation when it is inserted, this aligning screw being dimensioned to pass through the radial recess 70 of the opening 66.

The key 80 for unmating the connector parts has a shank portion 82 which is of the same diameter as the shank portion 82 of the key 78 but has a reduced diameter end portion 88 which is dimensioned for insertion through the opening 68. The reduced diameter end portion 88 has an eccentric projection 90 and an aligning screw 92 as described above.

When a technician wishes to mate the connector assembly parts with each other, he first moves the housing assembly 4 from the position of FIG. 1 to the position of FIG. 2. As will be explained below, guide ears are provided as shown at 112 for roughly aligning the parts with each other. When the assembly 4 is moved to the position of FIG. 2, the portions 12 of the terminals 8 will enter the cavities in the housing assembly 6 and the end portions of the terminals will be adjacent to the receptacle portions 26 of the terminals 10 as shown in FIG. 5. The technician will then insert the key 78 through the aligned openings 66 in the ears 48, 50 until the eccentric projection 84 enters the camming recess 74 as shown in FIG. 2. The technician then rotates the key and the eccentric projection will thereby move across the surface 75 of the recess 74 an exert a force on this surface. A reaction force will be exerted on the edges of the openings 66 and the entire housing assembly 4 will be moved rightwardly until the terminals are mated with each other as shown in FIG. 6. It is noteworthy that the key 78 can be used only to bring the two housing assemblies into fully mated condition and it cannot be used to unmate the parts because of the fact that the recess 74 is open on its right-hand side. If the technician rotates the key through a second rotation, it will have no effect on the mated connectors.

Unmating is carried out in reverse order excepting that the key 80 must be used. This key is inserted through the smaller diameter openings 68 until the eccentric projection 90 enters the recess 76. In this distance, the eccentric projection bears against the inner surface 77 of the recess 76 and the housing assembly 4 is thereby moved leftwardly.

Figure 14:
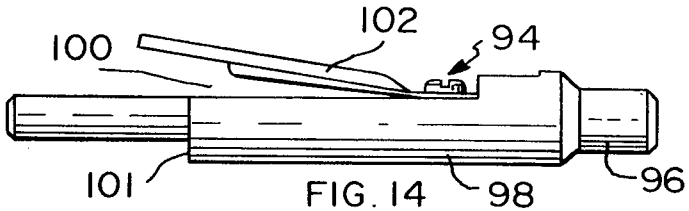
FIG. 14 is a view of an assurance plug which can be assembled to the connector assembly to indicate that the housing parts are properly mated with each other.

When the connector assembly is used under very critical conditions as in an electric power generating plant, it is desirable to have an indicator to show whether or not the two connector assemblies are fully and properly mated with each other. An assurance indicator as shown in FIG. 14 can be used for this purpose. The indicator 94 has a shank portion 98 and a free end 96. The shank portion has the same diameter as the large opening 66 but has a flat formed thereon as shown at 100. A retaining spring 102 is secured to this flat and extends obliquely from the surface thereof.

The end portion 96 of the assurance plug is dimensioned such that it will enter the recess 74 if the housing assemblies are fully mated with each other as shown in FIG. 3 and if it does enter this recess, the surface 101 of the assurance plug will be flush with the surface of the ear 50 as shown in FIG. 3. If the parts are not fully mated, the end of the assurance plug will not enter the camming recess 74 and a portion of the shank portion of the assurance plug will reject beyond the surface of the ear 50. If desired, a red marking can be placed on the plug so that the improper mating of the parts will be immediately apparent.

The essential features of the invention have been fully described above. In the accompanying drawings, a specific type of connector assembly is shown which is widely used in power generating stations however, the principals of the invention can be used with connector assemblies which are unlike the connector assemblies shown in the drawing. Accordingly, the other features of the housing assemblies will only briefly be described. Both of the housing assemblies are composed of a plurality of modules 108 which are in stacked relationship with each other. Each module contains a number of contact terminals of the type shown in FIG. 3. The modules are held in assembled relationship by top and bottom retaining plates 110, 114 and by the end plates which were previously described. These retaining plates can advantageously be made from extrusions and machined as required to produce the various screw holes and openings. In the disclosed embodiment, spaced-apart teeth 112 extend from the sidewall retaining plates of the housing assembly 4. The top and bottom retaining plates of the housing assembly 6 are formed to have recesses that receive the teeth 112 which extend from the assembly 4 and which also permit slight lateral movement so that the terminals can be fully mated with each other.

The disclosed embodiment has cable guides 118 for containing the wires extending from the posts 15, 22.

It will be apparent from the foregoing description that the principles of the invention can be used under a wide variety of circumstances to provide a force multiplying system for mating and unmating electrical connectors having large number of terminals therein and in addition, the invention provides for an extremely high degree of security over the connectors of the system in so far as mating and unmating are concerned for the reason that a separate removable parts are required to carry out the mating operation and the unmating operation.

I claim:

1. A multi-contact electrical connector assembly of the type comprising two connector parts, each of the parts comprising a housing assembly having contact terminals therein, each housing assembly having a mating face, oppositely facing endwalls and oppositely facing sidewalls, the endwalls and the sidewalls extending substantially perpendicularly of the mating face, the contact terminals in each housing assembly having a contact portion which is adjacent to the mating face, the contact terminals being of the type which are mated with each other by moving the terminals axially towards each other until the contact portions are in aligned overlapping and axially offset relationship and then moving the contacts laterally of their axis in a first lateral direction towards each other, the contact terminals being disengageable by moving the terminals laterally of their axes in a second lateral direction which is the opposite direction from the first lateral direction and then moving the terminals parallel to their axes away from each other, the connector assembly being characterized in that:

a connector assembly guide means is provided on the housing assemblies for guiding the assemblies towards each other from a spaced-apart position to a closed portion in which the mating faces are substantially against each other and the contact portions of the terminals are in overlapping offset relationship, first and second camming systems are provided for moving the housing assemblies in the first and second lateral directions respectively, the first camming system being incapable of moving the housing assemblies in the second lateral direction, the second camming system being incapable of moving the housing assemblies in the first lateral direction, the first and second camming systems being independent of each other, at least one of the camming systems having a readily removable camming part which, upon removal, immobilizes the one camming system whereby, upon removal of the one removable camming part, the housing assemblies cannot be moved in one of the lateral directions.

2. A multi-contact electrical connector assembly as set forth in claim 1 characterized in that each of the first and second camming systems has a readily removable camming part.

3. A multi-contact electrical connector assembly as set forth in claim 1 characterized in that the readily removable camming part comprises a key, the key comprising a cylindrical shank portion having a free end and having an eccentric projection on the free end, one of the housing assemblies having a cylindrical supporting bearing through which the free end of the key is insertable and which is dimensioned to support the shank portion for rotation, the other connector assembly having a camming surface which is engageable by the eccentric projection upon rotation of the key to move housing assemblies in the one lateral direction.

4. A multi-contact electrical connector assembly as set forth in claim 2 characterized in that the readily removable camming parts of the first and second camming systems comprise first and second keys, each key comprising a cylindrical shank portion having a free end and having an eccentric projection on the free end, one of the housing assemblies having first and second cylindrical supporting bearings through which the free ends of the first and second keys are insertable and which are dimensioned to support the shank portions for rotation, the other connector assembly having first and second camming surfaces which are engageable by the eccentric projections upon rotation of the keys to move the housing assemblies in the lateral directions.

5. A multi-contact electrical connector assembly as set forth in claim 2 characterized in that the first and second camming systems are dissimilar, the readily removable camming part of each one of the camming systems being inoperable in the other one of the camming systems.

6. A multi-contact electrical connector assembly as set forth in claim 4 characterized in that the first and second keys are dissimilar, the first key being unusable in the second camming system, the second key being unusable in the first camming system.

7. A multi-contact electrical connector assembly as set forth in claim 6 characterized in that the first key and the second key are dissimilar in that the diameter of the shank portion of the first key is different from the diameter of the shank portion of the second key.

8. A multi-contact electrical connector assembly as set forth in either of claims 1 or 7 characterized in that the connector assembly guide means comprises a guide rod extending from one of the housing assemblies and a guide bearing on the other assembly, the guide rod extending through the guide bearing.

9. A multi-contact electrical connector as set forth in claim 1 characterized in that an assurance member is provided for indicating the condition of the connector assembly, the assurance member being capable of being assembled to the one camming system which has a readily removable camming part only when the housing assemblies have been moved in one of the lateral directions.

10. A multi-contact electrical connector assembly as set forth in claim 7 characterized in that one assurance plug is provided which is insertable into one of the supporting bearings only when the housings assemblies have been moved in one of the lateral directions.

* * * * *